US007523714B1

(12) United States Patent
Ansay et al.

(10) Patent No.: US 7,523,714 B1
(45) Date of Patent: Apr. 28, 2009

(54) HYDRAULIC SAFETY CIRCUIT

(75) Inventors: Michael T. Ansay, Exeter, RI (US); Michael D. Wray, East Greenwhich, RI (US); George M. Duarte, Saunderstown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 420 days.

(21) Appl. No.: 11/499,972

(22) Filed: Aug. 2, 2006

(51) Int. Cl.
*B63G 8/28* (2006.01)

(52) U.S. Cl. ..... 114/319; 114/238; 89/1.812

(58) Field of Classification Search ..... 114/36, 114/318, 319, 238; 89/1.809, 1.812, 27.12; 244/63

See application file for complete search history.

(56) References Cited

U.S. PATENT DOCUMENTS

| | | | | |
|---|---|---|---|---|
| 3,735,668 | A | 5/1973 | Langlois et al. | |
| 4,416,183 | A | 11/1983 | Adams et al. | |
| 5,208,422 | A | 5/1993 | Moody | |
| 5,375,502 | A * | 12/1994 | Bitsakis | 89/1.81 |
| 5,542,334 | A | 8/1996 | Wells | |
| 5,936,188 | A | 8/1999 | Atkinson | |
| 6,220,196 | B1 * | 4/2001 | Escarrat | 114/238 |
| 7,357,093 | B2 * | 4/2008 | Potter et al. | 114/319 |
| 2005/0051076 | A1 * | 3/2005 | Owen | 114/312 |

* cited by examiner

*Primary Examiner*—J. Woodrow Eldred
(74) *Attorney, Agent, or Firm*—James M. Kasischke; Michael P. Stanley; Jean-Paul A. Nasser

(57) ABSTRACT

A hydraulic circuit for prevention of inadvertent weapons launches in which a hydraulic firing valve provides hydraulic pressure to a backup select valve rather than the backup select valve receiving hydraulic pressure directly from a ship supply header. This hydraulic pressure shifts the backup select valve to allow hydraulic pressure to pass to a mode select control valve that actuates a controllable air-firing valve, until a hydraulic firing valve for the weapon is opened. The backup select valve actuation can only occur with the initiation of the hydraulic firing valve. Only after the hydraulic firing valve is open, does the backup select valve initiate hydraulic pressure to the mode select control valve thereby preventing hydraulic actuation of the backup select valve.

9 Claims, 3 Drawing Sheets

- - PRIOR ART - -

- - PRIOR ART - -

HYDRAULIC SAFETY CIRCUIT

STATEMENT OF GOVERNMENT INTEREST

The invention described herein may be manufactured and used by or for the government of the United States of America for governmental purposes without the payment of any royalties thereon or therefor.

BACKGROUND OF THE INVENTION (1) Field of the Invention

The present invention relates to a hydraulic circuit and method of use for initiating and preventing inadvertent weapons launches.

(2) Description of the Prior Art

Weapon system failures on submarines have catastrophic consequences. For example: the inadvertent operation of an air valve may result in a serious event such as firing valves that provide the last isolation of high pressure air from entering critical launch system components, such as a launch air turbine. Once the high pressure air enters the launch air turbine, a full or partial launch can occur. With a weapon loaded in a torpedo tube, an accidental launch could be disastrous.

Several remedies to prevent inadvertent launch have been proposed with many of the remedies implemented. One such remedy, a software modification, has prevented numerous inadvertent launches from occurring; however, the software modification does not totally eliminate the risk of an inadvertent launch.

Modifications to the hydraulic control circuit have also been proposed to prevent inadvertent launches. However, these hydraulic modifications require the design and fabrication of new valves that would increase the weight and volume of the launch system. These modifications would also require a launch system redesign to accommodate the hydraulic valve and a new qualification test series to certify them with the result of complicated and costly changes.

A mechanical option in the hydraulic system would include the incorporation of a stronger coil spring used to bias the control valve to a closed position. This mechanical option is difficult and costly to implement.

As such, a need exists to substantially eliminate the possibility of an inadvertent launch in hydraulically actuated weapon systems.

SUMMARY OF THE INVENTION

The present invention is the modification of an existing hydraulic circuit to prevent inadvertent weapons launches. The hydraulic circuit has a backup select valve that is substantially devoid of actuating hydraulic pressure; a mode select control valve effective for actuating a controllable air-firing valve; in which the mode select control valve is communicatively connected to and responsive to actuating hydraulic pressure sent by the backup select valve. The hydraulic circuit also includes a hydraulic firing valve for the weapon, that once opens, provides actuating hydraulic pressure to the backup select valve effective to initiate hydraulic pressure to the mode select control valve. The hydraulic circuit is particularly useful in a controllable air-firing valve type system, such as a horizontal weapons system.

The present invention also details a method for preventing inadvertent weapons launch comprising the steps of providing a hydraulic circuit that prevents inadvertent weapons launches.

The present invention provides an active weapons launch platform (a ready-to-launch platform) where an actual weapon (s) launch can be initiated, with a reduced risk of inadvertent launch.

BRIEF DESCRIPTION OF THE DRAWINGS

A more complete understanding of the invention and many of the attendant advantages thereto will be readily appreciated as the same becomes better understood by reference the following detailed description when considered in conjunction with the accompanying drawings wherein.

DETAILED DESCRIPTION OF THE PREFERRED EMBODIMENT

The present invention provides a hydraulic control circuit designed to prevent inadvertent operation of a weapons system, particularly a submarine weapons system. Although particularly applicable to a submarine-based launch system, the hydraulic circuit of the present invention may be generally applied to any hydraulically operated launch system. As the hydraulic circuit provides positive control until a proper launch time, this control ensures the safety of the crew and non-destruction of the weapons platform. A failsafe launch resulting from the use of the hydraulic control circuit, described herein, is possible without having to perform excessive and costly redesign work, or requiring new valves or extensive modifications to the existing valves.

Figure 1:
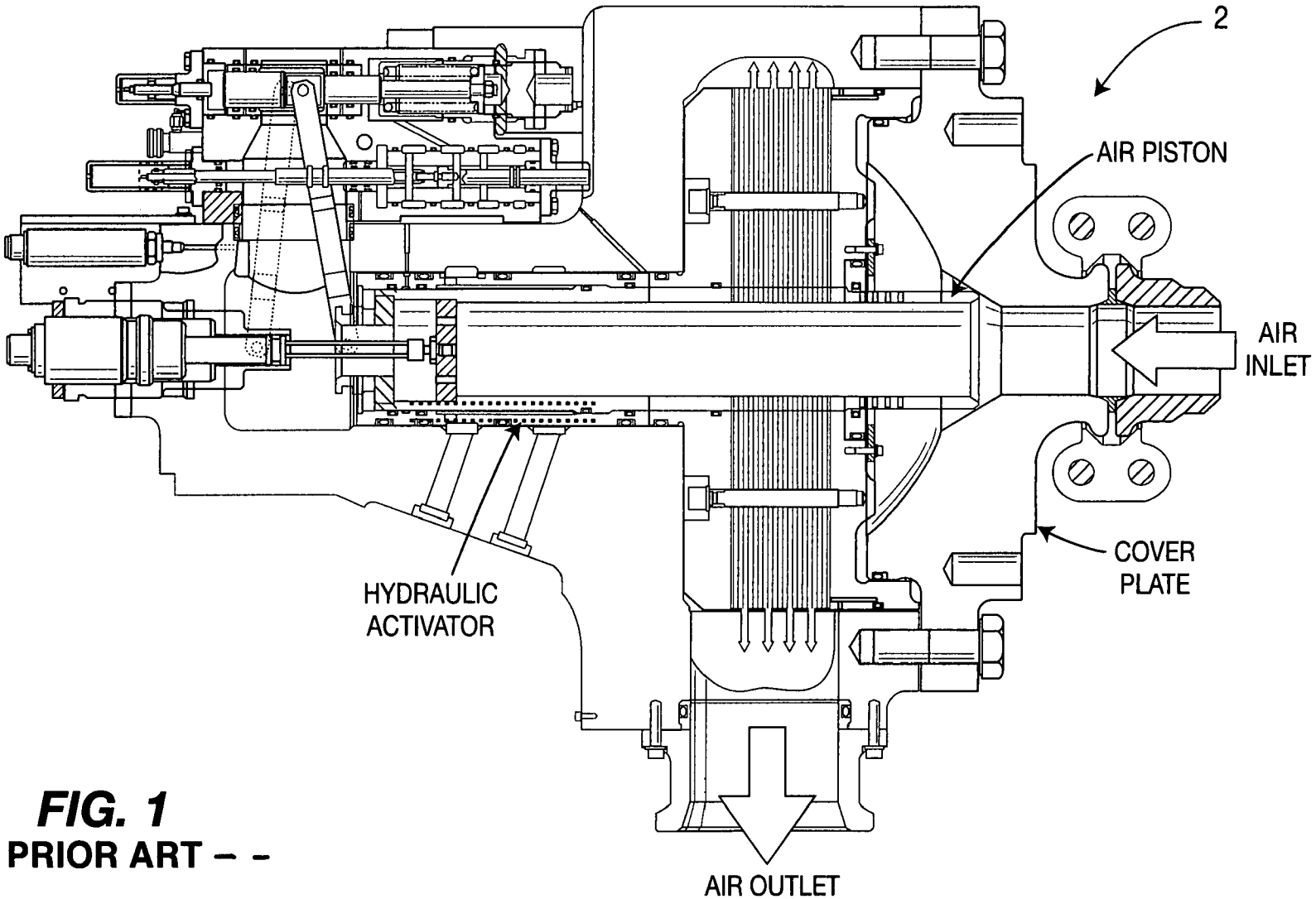
FIG. 1 depicts a section view of a prior art controllable air-firing valve.

FIG. 1 depicts an existing electro-mechanical device used in the launch of a torpedo. The device is a hydraulically operated controllable air firing valve 2 that provides high pressure air to a launch system through a system that opens and closes an air piston 4 to the launch system.

Figure 2:
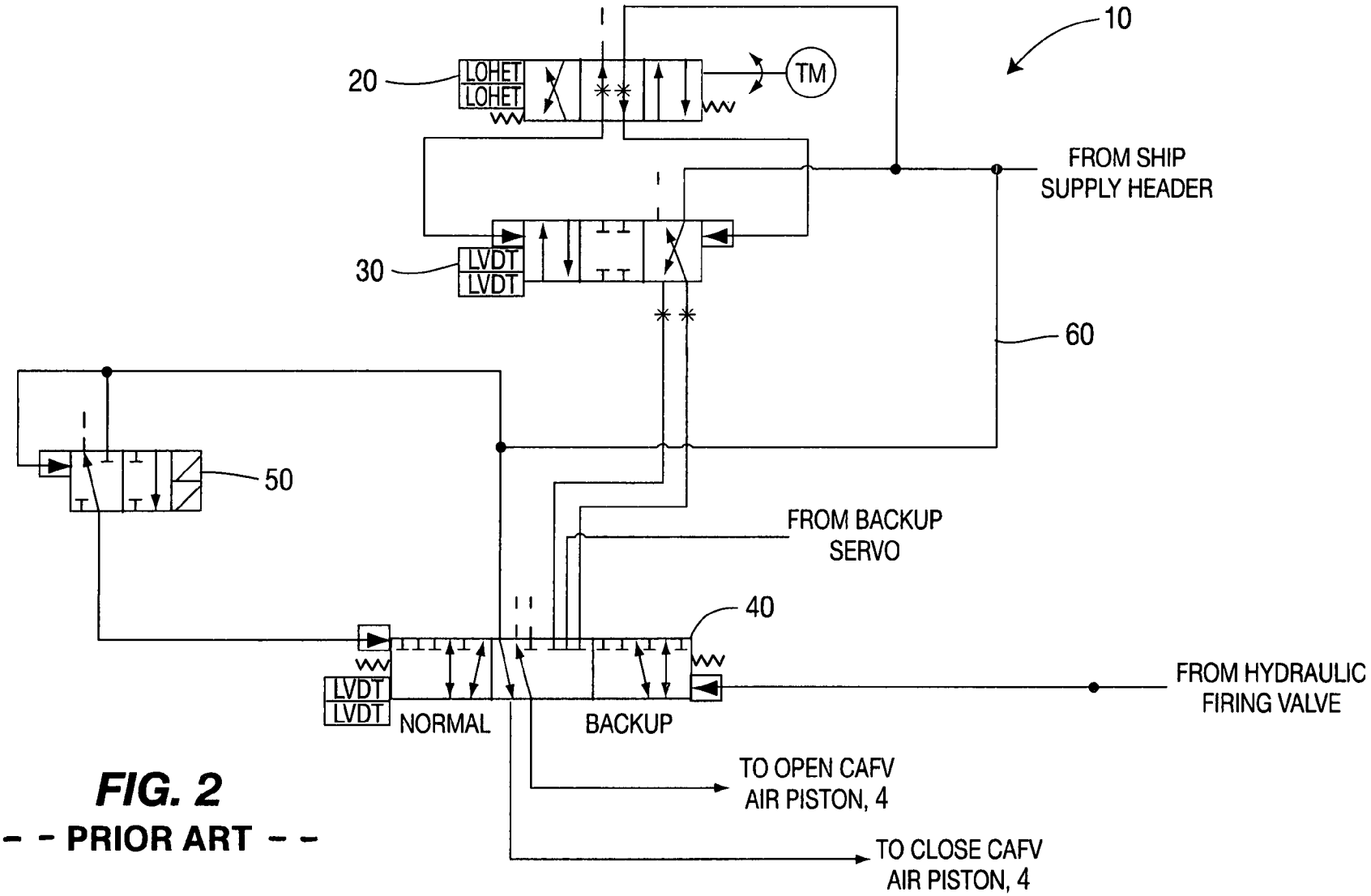
FIG. 2 depicts a prior art hydraulic control circuit for a launch system.

FIG. 2 represents the prior art configuration of the launch assembly hydraulic control circuit 10 without the modifications of the present invention incorporated therein. In FIG. 2, the valves that make up the hydraulic control circuit 10 are identified. This positioning of the launch system is done through the cascading use of a direct drive valve 20 and a servo valve 30.

The direct drive valve 20 is an electro-hydraulic valve capable of electronics control. The direct drive valve 20 provides hydraulic pressure to position the servo valve 30 by controlling the direction of hydraulic fluid to the servo valve 30. The servo valve 30 is a three-position valve that provides hydraulic pressure to a mode select control valve 40. With the input from the direct drive valve 20 to drive the position of the servo valve, the servo valve controls the direction of hydraulic fluid to the air piston 4.

The intermediate position of the servo valve 30 is used to minimize the electrical loads required to operate the direct drive valve 20 and to speed up the responsiveness of the system; otherwise, a servo valve would not be necessary and the direct drive valve could provide direct control of the air piston.

An additional valve represented in the hydraulic control circuit of FIG. 2 is backup select valve 50. The backup select valve 50 provides hydraulic pilot pressure to the mode select control valve (MSCV, 40) such that the mode select control valve is positioned for a NORMAL mode launch. The existing hydraulic circuit, shown in FIG. 2, shifts the MSCV 40 into NORMAL by first electrically energizing the backup select valve (BSV, 50). Because a constant supply of hydraulic pressure is maintained at the BSV 50, once the BSV is electrically energized, hydraulic pressure is allowed to immediately pass through to open the MSCV 40. This is potentially dangerous as the BSV 50 is energized every time a torpedo tube slide valve (not shown) is opened. Especially dangerous, in that the slide valve may remain open for extended periods of time before a weapon launch is actually performed.

The BSV 50 is electrically actuated and also hydraulically actuated. The hydraulics of the BSV 50 has a positive supply pressure available at all times. The electrical actuation of the BSV 50 is only energized when a launch is pending (i.e., when the slide valve is open). When the slide valve opens, the electrically applied force on the BSV 50 is larger than the constant hydraulically applied force. In this way, the electrical solenoid force overcomes the hydraulic force to open the BSV 50. The electrical solenoid force is later removed from the BSV 50 after the launch event is complete. The dominant hydraulic shift force automatically returns the BSV 50 to a closed position. This automatic return of the BSV 50 removes the hydraulic pressure from the MSCV 40 allowing the MSCV to close.

As seen in FIG. 2, the MSCV 40 is a three-position, dual piloted valve that controls hydraulic pressure. The MSCV 40 is positioned to either the NORMAL or BACKUP mode from the CLOSED mode, by pilot pressure applied to the MSCV by the BSV 50 and/or a hydraulic firing valve (not shown). If the MSCV 40 is aligned in the NORMAL position, the servo valve (SV, 30) hydraulic pressure of the passes through the MSCV to drive the launch assembly. Once the torpedo tube slide valve is opened, an electrical command is supplied to the BSV 50 to shift the MSCV 40 into NORMAL position. With the MSCV 40 in the NORMAL position, the air piston 4 can be controlled by directional porting of hydraulic fluid through the SV 30 and direct drive valve (DDV, 20).

With the MSCV 40 in the center CLOSED position, control of the air piston 4 is blocked, and until the MSCV shifts into NORMAL position, the air piston cannot open regardless of the SV 30 and DDV 20 positions. The third MSCV 40 position, the BACKUP position, is used in the event of an electrical failure. In the event of both pilots having pressure applied simultaneously, the larger NORMAL mode pilot will override the smaller BACKUP pilot and shift the MSCV 40 to a NORMAL launch mode. Conventionally, the hydraulic firing valve provides hydraulic pilot pressure directly to the MSCV 40, and does not provide any hydraulic pressure to the BSV 50.

During an initial part of the firing sequence for a normal weapon launch, the MSCV 40 shifts into NORMAL position. The hydraulic firing valve is later actuated. An inadvertent launch only occurs after the MSCV 40 has been shifted into NORMAL position. A proper launch does not begin until when the hydraulic firing valve is opened. After the hydraulic firing valve opens, a launch must occur, but not before.

Concurrent with the opening of the hydraulic firing valve, electrical control of the DDV 20 is simultaneously started. Prior to this step, the DDV 20 should be in a biased-closed position. However, due to mechanical drift, software timing/control errors, large electrical spikes, or other occurrences, the DDV 20 may improperly drift into a biased-open position. This may cause an inadvertent launch as soon as the MSCV 40 shifts into NORMAL. This remains a concern every time the torpedo tube slide valve is opened such as when the BSV 50 has switched the MSCV 40 to NORMAL but prior to the hydraulic firing valve being opened.

If an inadvertent launch does not occur with the opening of the slide valve, launch may still occur anytime thereafter while the slide valve remains open. Under these conditions, an inadvertent launch is possible when the DDV 20 is improperly positioned to port hydraulic fluid to open the air piston 4 before called for electrically. With the DDV 20 biased to open, the air piston 4 will immediately start opening once the MSCV 40 shifts into the normal launch position. The proper sequence of events requires the DDV 20 to port hydraulic fluid to close the air piston 4 before the MSCV 40 shifts into NORMAL and then hold that position until the hydraulic firing valve opens. Only at that point (after the hydraulic firing valve opens) should the DDV 20 begin with electrical control to open the air piston 4.

There is a likelihood that the DDV 20 hydraulic alignment improperly biases to an open position without electronic input at the time the MSCV 40 shifts into NORMAL, whereas the DDV had been designed to remain in a biased CLOSED position. Once the DDV 20 drifts into a biased OPEN position, only the MSCV 40 prevents the air piston 4 from opening. In a regular firing sequence opening the MSCV 40 prior to the hydraulic firing valve could cause an inadvertent launch to occur.

Figure 3:
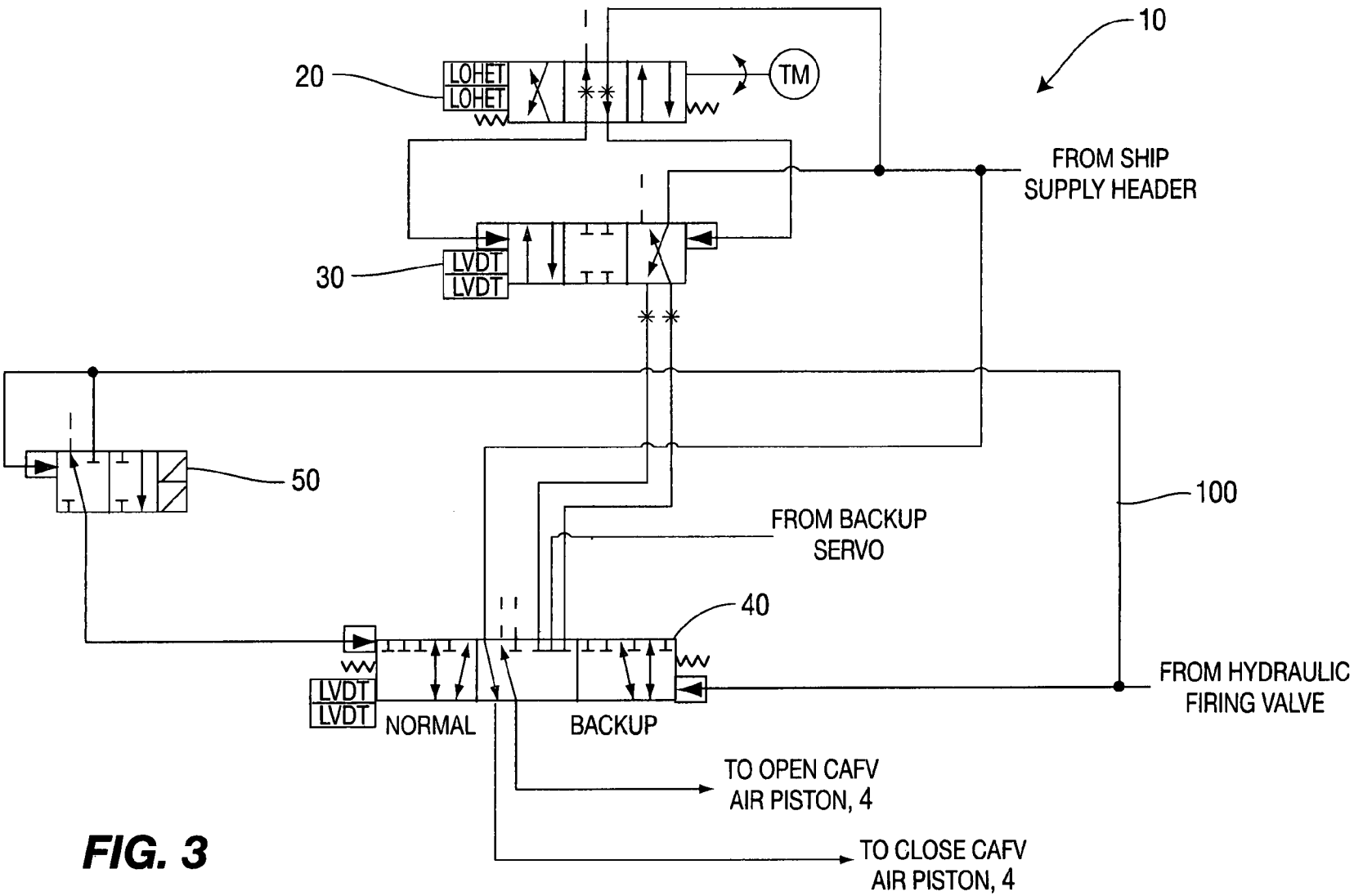
FIG. 3 depicts a modified hydraulic control circuit of the present invention.

The present invention, shown in FIG. 3, incorporates much of the existing hydraulic circuit, but remedies the problems, associated with the hydraulic circuit shown in FIG. 2. In FIG. 2, the BSV 50 is shown to be supplied a constant hydraulic pressure from the ship supply header.

The present invention, shown in FIG. 3, provides hydraulic pilot pressure line 100 directly from the hydraulic firing valve to the BSV 50 rather than directly from the ship supply header. This hydraulic pilot pressure shifts the BSV 50 to allow hydraulic pressure to pass to the MSCV 40 and to provide the pass through hydraulic pressure to the MSCV. As the hydraulic circuit of the present invention uses a BSV that is substantially devoid of actuating hydraulic pressure from the ship supply header; actuation can only occur with the initiation of the hydraulic firing valve.

Although the MSCV 40 in the present invention is hydraulically connected and responsive to actuating hydraulic pressure sent by the BSV 50, the BSV is fed actuating hydraulic pressure from the hydraulic firing valve, and only after the HFV is open, does the BSV initiate hydraulic pressure to the MSCV.

In operation, the hydraulic circuit of the present invention is used for prevention of inadvertent weapons launches by causing the BSV 50 to open in response to opening of the hydraulic firing valve. Once the BSV 50 has been supplied with hydraulic pressure from the hydraulic firing valve, the BSV causes the MSCV 40 to shift to its NORMAL position. Preferably, actuating hydraulic pressure is maintained in the hydraulic firing valve after a weapon launch effectuates the closure of the BSV 50. The present invention restricts the MSCV 40 to remain in the CLOSED position until a launch becomes absolute.

Elimination of an inadvertent launch is achieved by eliminating the constant supply of hydraulic pressure to the BSV 50. Instead, hydraulic pressure is only provided to the BSV 50 after the hydraulic firing valve opens when a launch is absolute. No changes are necessary to the electrically energized side of the BSV 50, and preferably the situation would remain unchanged. Additionally no change is necessary to the hydraulic side of the BSV. In this way, it is the MSCV 40 not the BSV 50 which serves as the final line of protection against inadvertent launches, because regardless of the DDV 20 position, the air piston 4 cannot be opened when the MSCV is in the CLOSED position.

In addition to the timing delay for control of the DDV 20, the only required modification to the circuit is the elimination of hydraulic supply line 60 to the BSV 50 from the ship supply header and the addition of the hydraulic line 100 connecting the hydraulic firing valve to the BSV 50. The tasks to eliminate the constant hydraulic supply to the BSV 50 and to install the new hydraulic line 100 are well known by those skilled in the art hydraulic systems. As such, the present invention is useful for reconfiguring current hydraulic systems, as well as for incorporation into newly manufactured hydraulic systems.

By using the hydraulic firing valve to supply hydraulic pressure to the BSV 50, the MSCV 40 cannot shift into NORMAL even though the BSV has already been electrically energized. Consequently, the slide valve can be opened and remain open as long as necessary without the risk of an inadvertent launch. This is because no hydraulic pressure will be available to the BSV 50 until the hydraulic firing valve opens, which is when a launch must be performed. When the electrical force is later removed from the BSV 50 (after the launch event is complete), the HFV pressure still remains. This ensures that the BSV 50 closes. The BSV 50 then remains closed after the hydraulic firing valve pressure is removed and all valves are returned to their safe standby position until the next launch.

The number of valves required to prevent inadvertent launch is minimized, as the present invention does not require any additional valves over the number used in the previous design. More valves would only increase the complexity of the controllable air firing valve 2 operation, placing a greater demand on the hydraulic system by increasing system flow losses. Complex software modifications to the existing electronic control programs also remain unnecessary. Because additional valves are not required, costs and weight increases are minimized. The cost of designing, fabricating, and testing a new valve is also avoided. Other mechanical modifications, such as a stiffer coil spring in the DDV 20 to help bias the DDV closed are unneeded.

The hydraulic circuit of the present invention ensures an active weapons platform at the appropriate time, after the hydraulic firing valve has been initiated. Once the hydraulic firing valve has been initiated, the present invention eliminates the risk of an inadvertent launch. The hydraulic circuit is applicable to any appropriate controllable air-firing valve system, such as a horizontal weapons system.

The foregoing description of the preferred embodiments of the invention has been presented for purposes of illustration and description. It is not intended to be exhaustive nor to limit the invention to the precise form disclosed; variations are possible in light of the above teaching. Such modifications and variations that may be apparent to one skilled I the art are indicated to be included within the scope of this invention as defined by the accompanying claims.

What is claimed is:

1. A hydraulic circuit for weapons launches comprising:

a hydraulically-controlled backup select valve, a controllable air firing valve capable of initiating a weapons launch;

a mode select control valve fluidly connected to said backup select valve, wherein said mode select control valve is responsive to actuating hydraulic pressure sent by said backup select valve; and a hydraulic firing valve fluidly connected to said backup select valve and said mode select control valve, wherein opening said hydraulic firing valve provides actuating hydraulic pressure to the backup select valve effective to initiate hydraulic pressure to shift said mode select control valve to actuate said controllable air firing valve.

2. The hydraulic circuit in accordance with claim 1, further comprising a direct drive valve and a servo valve fluidly connected to said mode select control valve wherein said servo valve is interposed between said direct drive valve and said mode select control valve.

3. The hydraulic circuit in accordance with claim 1, wherein said backup select valve is capable of electric actuation.

4. The hydraulic circuit in accordance with claim 3, wherein the actuating hydraulic pressure from said hydraulic firing valve to said backup select valve is greater than the electric actuation force of said backup select valve.

5. A method for initiating a weapons launch, said method comprising the steps of:

providing a hydraulic circuit having a hydraulically-controlled backup select valve, a mode select control valve fluidly connected to the backup select valve and effective for actuating a controllable air-firing valve in which the mode select control valve is communicatively connected to and responsive to actuating hydraulic pressure sent by the backup select valve and a hydraulic firing valve for the weapon wherein once the hydraulic firing valve is open, the hydraulic firing valve provides actuating hydraulic pressure to the backup select valve effective to initiate hydraulic pressure to the mode select control valve;

opening the hydraulic firing valve;

opening the backup select valve to in response to said opening of the hydraulic firing valve;

opening the mode select control valve in response to said opening of the backup select valve;

actuating the controllable air-firing valve with the mode select control valve; and initiating the weapons launch.

6. The method in accordance with claim 5, further comprising the step of maintaining the actuating hydraulic pressure in the hydraulic firing valve after the weapons launch to a level that closes the backup select valve.

7. The method in accordance with claim 5, wherein said step of opening the backup select valve in response to opening of the hydraulic firing valve thereby causes the mode select control valve to shift to a normal and open position.

8. The method in accordance with claim 7, wherein said step of causing the mode select control valve to open in response to the opening of the backup select valve allows hydraulic pressure from a direct drive valve to actuate the controllable air-firing valve.

9. The method in accordance with claim 5, wherein the actuating hydraulic pressure from the hydraulic firing valve to the backup select valve is greater than the electrically actuated electro-actuated force of the backup select valve.

* * * * *